US011891257B2

(12) United States Patent
Gumpinger et al.

(10) Patent No.: US 11,891,257 B2
(45) Date of Patent: Feb. 6, 2024

(54) FILM WINDING SYSTEM AND FILM STRETCHING UNIT USING SUCH FILM WINDING SYSTEM

(71) Applicant: BRÜCKNER MASCHINENBAU GmbH, Siegsdorf (DE)

(72) Inventors: Helmut Gumpinger, Anger (DE); Xaver Schwarz, Waging a See (DE); Jens Adler, Siegsdorf (DE); Anthimos Giapoulis, Traunstein (DE)

(73) Assignee: BRÜCKNER MASCHINENBAU GmbH, Siegsdorf (DE)

( * ) Notice: Subject to any disclaimer, the term of this patent is extended or adjusted under 35 U.S.C. 154(b) by 49 days.

(21) Appl. No.: 17/339,034

(22) Filed: Jun. 4, 2021

(65) Prior Publication Data

US 2021/0380364 A1 Dec. 9, 2021

(30) Foreign Application Priority Data

Jun. 5, 2020 (DE) ..... 10 2020 115 007.5

(51) Int. Cl.
*B65H 18/16* (2006.01)
*B65H 23/04* (2006.01)

(52) U.S. Cl.
CPC ..... *B65H 23/044* (2013.01); *B65H 18/16* (2013.01)

(58) Field of Classification Search
CPC ..... B65H 23/00; B65H 23/044; B65H 23/26; B65H 18/08; B65H 18/16; B65H 18/26; B65H 19/2215
See application file for complete search history.

(56) References Cited

U.S. PATENT DOCUMENTS 4,343,440 A * 8/1982 Engl ..... B65H 18/26 242/547
4,798,350 A * 1/1989 Jorgensen ..... B65H 19/267 242/533.4
5,397,514 A 3/1995 Breil et al.
2014/0299705 A1 10/2014 Martinez et al.

FOREIGN PATENT DOCUMENTS

| | | |
|---|---|---|
| DE | 1 216 521 | 5/1966 |
| DE | 102009005355 | 7/2009 |
| EP | 1232982 | 8/2002 |
| EP | 1 640 300 | 3/2006 |
| JP | H09315632 | 12/1997 |

* cited by examiner

*Primary Examiner* — Sang K Kim
(74) *Attorney, Agent, or Firm* — Nixon & Vanderhye P.C.

(57) ABSTRACT

A film winding system (1) for a film stretching unit (110) comprises a film entry area (3) through which a film web (2) to be wound can be fed to the film winding system (1). A first winding station (4) is configured in a winding position to wind the film web (2) into a film bale (5). A contact roller (6) and a measuring roller (8) are provided, the contact roller (6) being arranged adjacent to the first winding station (4) in the winding position and being configured to guide the film web (2) to the first winding station (4). The measuring roller (8) is arranged before the contact roller (6) in the movement direction of the film web (2) and is configured to guide the film web (2) to the contact roller (6). A first adjustment device (10) is provided and configured to move the measuring roller (8) relative to the contact roller (6) along a travel path in such a way that a degree of wrapping over which the film web (2) covers the contact roller (6) can be varied.

19 Claims, 8 Drawing Sheets

FILM WINDING SYSTEM AND FILM STRETCHING UNIT USING SUCH FILM WINDING SYSTEM

Figure 1:
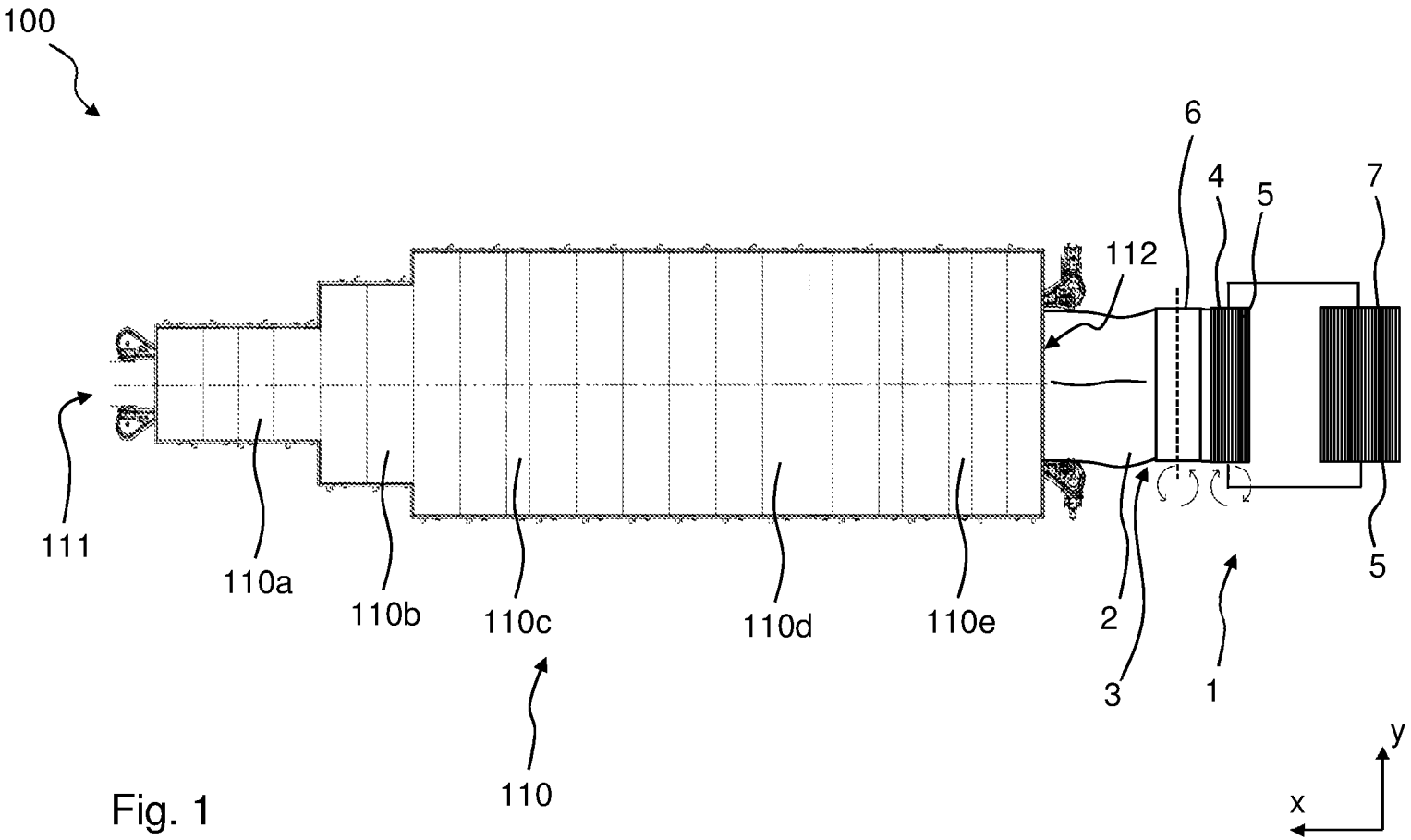

This application claims priority to DE Patent Application No. 10 2020 115 007.5 filed Jun. 5, 2020, the entire contents of which are hereby incorporated by reference.

The invention relates to a film winding system and an assembly of a film stretching unit with such a Film winding system.

Film stretching units are used to produce a film web from a plastic melt which has certain material properties so that it can be used for specific purposes. The film stretching units comprise longitudinal and/or transverse stretching zones. The line speed is increasing more and more and is nowadays already more than 400 m/min. In the future, even faster film stretching units will be put into operation. In this context, an important aspect is also how the finished end product, namely the film web, is wound up. Film winding systems are provided for this purpose, which wind up the film web produced. When winding, however, it is important that no folds are pressed into the film web and that sufficient air is still wrapped in so that the individual layers can be separated from each other more easily later. The film web is wound up at a winding station. The winding station comprises a corresponding base body around which the film web is wound. However, the film web is fed to an internally known winding station via a contact roller to ensure optimum alignment before winding. The film web covers the contact roller over 90° or over 0°. In the case of an overlap, which is named in the following "degree of wrapping", of 0°, the film web runs between the contact roller and the film bale (also referred to as the wrapping bale) into the film bale. Using a degree of wrapping of 90°, the film web is deflected by 90° at the contact roller before it runs into the film bale. At higher line speeds, there is definitely room for improvement for this internally known concept.

The object is therefore to create a film winding system and an assembly of a film winding system and a film stretching unit that ensures that the film web is reliably wound up.

The object is solved by the film winding system according to the pending claims and by the assembly of the film stretching unit and the film winding system according to the pending claims. The dependent claims comprise further embodiments of the film winding system.

The film winding system comprises a film entry area through which a film web to be wound can be fed to the film winding system. A first winding station is also provided. The first winding station is configured in a winding position to wind the film web into a film bale. A contact roller and a measuring roller are also provided. The contact roller is arranged (directly) adjacent to the first winding station (when the latter is in the winding position) and configured to guide the film web to the first winding station. The term "directly" should be understood in such a way that the contact roller is in contact with the film bale or that only the film web, which is wound onto the film bale, runs between the contact roller and the film bale. However, a free space could also be formed between the contact roller and the film bale. This free space, namely the distance, is preferably smaller than 100 cm, 80 cm, 70 cm, 60 cm, 50 cm, 40 cm, 30 cm, 20 cm, 10 cm, 5 cm, 3 cm, 2 cm, 1 cm or smaller than 0.1 cm. The measuring roller is arranged in front of (before) the contact roller in the movement direction of the film web and is configured to guide the film web to the contact roller. The wording "in the movement direction of the film web" should be understood in such a way that a certain area of the film web first runs over the measuring roller and only then (after that) over the contact roller. Furthermore, a first adjustment device is provided and configured to move the measuring roller relative to the contact roller along a travel path in such a way that a degree of wrapping over which the film web covers (touches) the contact roller can be changed. A "degree of wrapping" is a value of how far the film web covers the contact roller. The contact roller extends over 360°. Having a degree of wrapping of 90°, the film web would only rest on a quarter of the circumferential surface of the contact roller, which is in particular cylindrical. Having a degree of wrapping of 180°, on the other hand, the film web would rest on half of the outer surface of the contact roller, which is in particular cylindrical.

It is particularly advantageous that the degree of wrapping can be varied. This is achieved by first passing the film web over a measuring roller and only then transferring it from the measuring roller to the contact roller. By changing the position of the measuring roller in relation to the position of the contact roller, the degree of wrapping can be changed because the area of impact of the film web on the contact roller can be adjusted. According to the invention, the degree of wrapping can therefore be individually amended to the requirements of the film web. The degree of wrapping can therefore be optimally adjusted to film properties, such as material thickness, material strength, material elongation or shrinkage. For each material, therefore, an optimum can be set with regard to the degree of wrapping to achieve the best film bale. For small degrees of wrapping, the contact roller can only have a minor influence on the film tension. With larger degrees of wrapping, an increasingly greater influence can be exerted on the film tension (through drive or braking torques on the contact roller). Extensive internal investigations have shown that smaller degrees of wrapping are advantageous for thick film webs, while larger degrees of wrapping are advantageous for thin film webs. Thicker film webs are less affected by film web flutter than thinner film webs. Stiffer film webs can be wound better with degrees of wrapping close to 0°, while film webs with shrink films, for example, are wound better with larger degrees of wrapping. It was found out that, in particular, a film web with a shrink film should be wound with a degree of wrapping of approximately 90° (less than 3° deviation), whereas film webs with a thick film or with a film of high strength should be wound with a degree of wrapping of approximately (less than 3° deviation) 0°.

In one embodiment of the film winding system, the first adjustment device is configured to move the measuring roller relative to the contact roller along the travel path during operation, i.e. while the film web is being wound, in order to change the degree of wrapping during operation. This makes it possible to react immediately to changing parameters of the film web. For example, it is possible that the film web to be produced changes very quickly, requiring different degrees of wrapping. Loosening screw connections and rebuilding system parts is then not necessary and would also not be helpful. The first adjustment device is configured in particular to move the measuring roller steplessly relative to the contact roller. Moving the measuring roller in discrete steps (for example via latching steps) relative to the contact roller would also be possible.

The first adjustment device is configured to move the measuring roller along the entire travel path or along the predominant part of the travel path with a first movement vector and/or a second movement vector. For this purpose, the first adjustment device comprises a first guide system. The first guide system can be used to move with the first movement vector. In addition or alternatively, the first adjustment device also comprises a second guide system. The second guide system can be used to move with the second movement vector. The first or second guide system can be in form of a slide system or a rail system, for example. The measuring roller itself can be mounted on the first guide system or the second guide system. Optionally, it is again possible for the first guide system to be mounted on the second guide system or for the second guide system to be mounted on the first guide system. In this case, it would be possible for the measuring roller to be moved via the first guide system with the first movement vector and simultaneously via the second guide system with the second movement vector. However, this is optional. In a simple embodiment, the measuring roller could be moved only with the first movement vector or only with the second movement vector. The movement of the measuring roller in order to change the degree of wrapping is always relative to the contact roller.

In one embodiment of the invention, the first movement vector comprises only one component in the X-direction. This component is unequal to zero. The other components (Y-direction, Z-direction) are zero. The X-direction runs parallel to the floor in the direction of the film entry area. The Y-direction runs in the longitudinal direction of the contact roller or the measuring roller. The Z-direction runs perpendicular to the ground away from the ground. The second movement vector comprises components in the X-direction and in the Z-direction which are unequal to zero. The component in Y-direction is zero. This means that the measuring roller only moves horizontally when moving with the first movement vector. When moving with the second movement vector, the measuring roller would move slantwise.

When the measuring roller is moved with the second movement vector, it can be moved further in the Z-direction than in the X-direction over the entire travel path. It would also be possible for the measuring roller to be moved further in the X-direction than in the Z-direction. In principle, the measuring roller could also be moved for the same distance in the Z-direction as in the X-direction over the entire travel path (45° course). When moving the measuring roller with the second movement vector, the ratio between the component in the X-direction and the component in the Z-direction would preferably be constant over most of the travel path or over the entire travel path.

Preferably, the second movement vector forms an angle with an XY-plane that is larger than 10°, 20°, 30°, 40°, 50°, 60° or that is larger than 70°, but that is further preferably smaller than 80°, 75°, 65°, 55°, 45°, 35°, 25° or smaller than 15°.

Alternatively, the travel path of the measuring roller could also be arc-shaped. In this context, it would also be possible for the travel path of the measuring roller to comprise several arcuate segments that are connected directly to one another or the use of linearly extending sections.

Particularly preferably, the first adjustment device is configured to position the measuring roller between a first position and a second position in order to adjust the degree of wrapping. In the first position, the measuring roller is only vertically spaced (above or below) from the contact roller. As a result, the film web runs between the measuring roller and the contact roller almost exclusively with a vertical component. As a result, a degree of wrapping of approximately 0° can be set at the contact roller. Furthermore, in the second position, the measuring roller is only spaced from the contact roller in the horizontal direction (in the film take-off direction between the film entry area and the contact roller). As such, the film web runs between the measuring roller and the contact roller almost exclusively with a horizontal component. As a result, a degree of wrapping of 90° can be set on the contact roller. A position of the measuring roller between the above described first and the second positions result in a degree of wrapping between 0° and 90°.

In a preferred embodiment, a control device is also provided. The control device is configured to control the first adjustment device in such a way that the first adjustment device moves the measuring roller in such a way that a predetermined setpoint for the degree of wrapping is achieved. This setpoint can be loaded by the control device from a data memory, for example, or received by the control device from an input unit (keyboard, for example). It would also be possible for the control device to calculate the setpoint. In this context, the control device could be configured to load at least one material property of the film web, such as the film type, material thickness, material strength, material elongation, shrinkage and/or film temperature from a data memory and/or to receive it from an input unit (keyboard, for example).

The control device could then calculate the setpoint for the degree of wrapping from this at least one material property. In addition or alternatively, the control device could be configured to load at least one line parameter of the film stretching unit, such as the line speed and/or the film tension, from a data memory. In addition or alternatively, the control device could be configured to receive the at least one line parameter from an input unit. Depending on this at least one line parameter, the control device could be configured to calculate the setpoint for the degree of wrapping. Depending on the setpoint, the measuring roller can then be moved accordingly. Certain positions of the measuring roller can be stored in a lookup table together with certain wrapping degrees. A corresponding formula could also be stored (for example an equation) so that the control device is configured to calculate the corresponding position of the measuring roller depending on the setpoint by using that formula.

Preferably, a force measuring device is also provided and arranged on the measuring roller. The force measuring device is then configured to measure an actual value for film tension and to transmit it to the control device. The control device is again configured to compare the actual value for the film tension with a setpoint (target value) for the film tension. Depending on this comparison, the control device is configured to increase, reduce or maintain the degree of wrapping. This prevents thin films from tearing, for example.

In a preferred embodiment, a deflection roller and a second adjustment device are also provided. The deflection roller is arranged between the film entry area and the measuring roller. The second adjustment device is configured to move the deflection roller in the vertical direction in such a way that the film web can be aligned approximately horizontally (less than 5° deviation) between the deflection roller and the measuring roller or between the deflection roller and the contact roller. By the use of the deflection roller, in particular identical conditions at the measuring roller are achieved, so that a force measuring device used there provides measurement results that can be compared with each other even with different degrees of wrapping.

To further increase the stabilization of the film web, a first and/or a second stabilizing roller are preferably also provided and can be arranged at a first edge region of the film web. The first stabilizing roller can be brought into contact with an upper side of the film web and the second stabilizing roller with an underside of the film web. The first and second stabilizing rollers are preferably only spaced apart from each other in the vertical direction and are thus arranged directly above each other so that they support each other. Furthermore, a third and/or a fourth stabilizing roller are provided, which are arranged in the same way as the first and second stabilizing rollers. However, the third and fourth stabilizing rollers can be arranged at a second edge region opposite the first edge region. The first edge region could be a right edge region of the film web and the second edge region could be a left edge region of the film web. An "edge region" is to be understood as the region of the film web which is spaced from the respective side edge preferably by less than 50 cm, 40 cm, 30 cm, 20 cm or by less than 10 cm. Instead of a stabilizing roller, it is also possible to speak of a spreader.

Preferably, a third adjustment device is also provided, wherein the contact roller is attached to the third adjustment device. The third adjustment device is configured to move the contact roller in the direction of the film entry area. This ensures that the distance between the contact roller and the increasingly thick film bale is constant and that the contact roller always bears against the film bale with a defined contact pressure. The third adjustment device preferably moves the contact roller by a movement vector that preferably has only one component in the X-direction. Preferably, the measuring roller is moved with the same movement vector as the contact roller when the contact roller is moved. This ensures that the degree of wrapping can also be kept constant during operation if required.

In a further embodiment, the film winding system also comprises at least one discharge device. The discharge device is arranged in the area of the film web and is configured to discharge an electrical charge on the film web or film bale. Such an electrical charge can otherwise be life-threatening for the operating personnel. The discharge device preferably comprises a plurality of flexible/free-moving electrically conductive metal strips (a type of tinsel strip) which can be brought into contact with the film web. These metal strips are preferably arranged over the entire width of the film web or over the predominant width of the film web. In principle, a discharge conductor (rod-like for example) could also be used. This or these discharge conductors would preferably be arranged at a distance from the film web. The distance should preferably be smaller than 30 mm, 20 mm, 10 mm or smaller than 5 mm. Preferably, however, the distance is larger than 4 mm or 5 mm. An alternating electric field is applied to this discharge conductor. This alternating electric field is a high voltage, whereby the static charge is discharged.

The assembly of the film winding system and a film stretching unit according to the invention allows the film winding system to be connected to an exit area of the film stretching unit. The film stretching unit comprises an input section at which a film or plastic meld can be fed to it. Furthermore, the film stretching unit comprises various zones in which the plastic film or the plastic meld is heated and stretched into a mono- or bi-axially oriented film web (for example, via a longitudinal stretching stage and/or via a transverse stretching stage and/or oven). The resulting film web is then fed to the film winding system.

Figure 4:
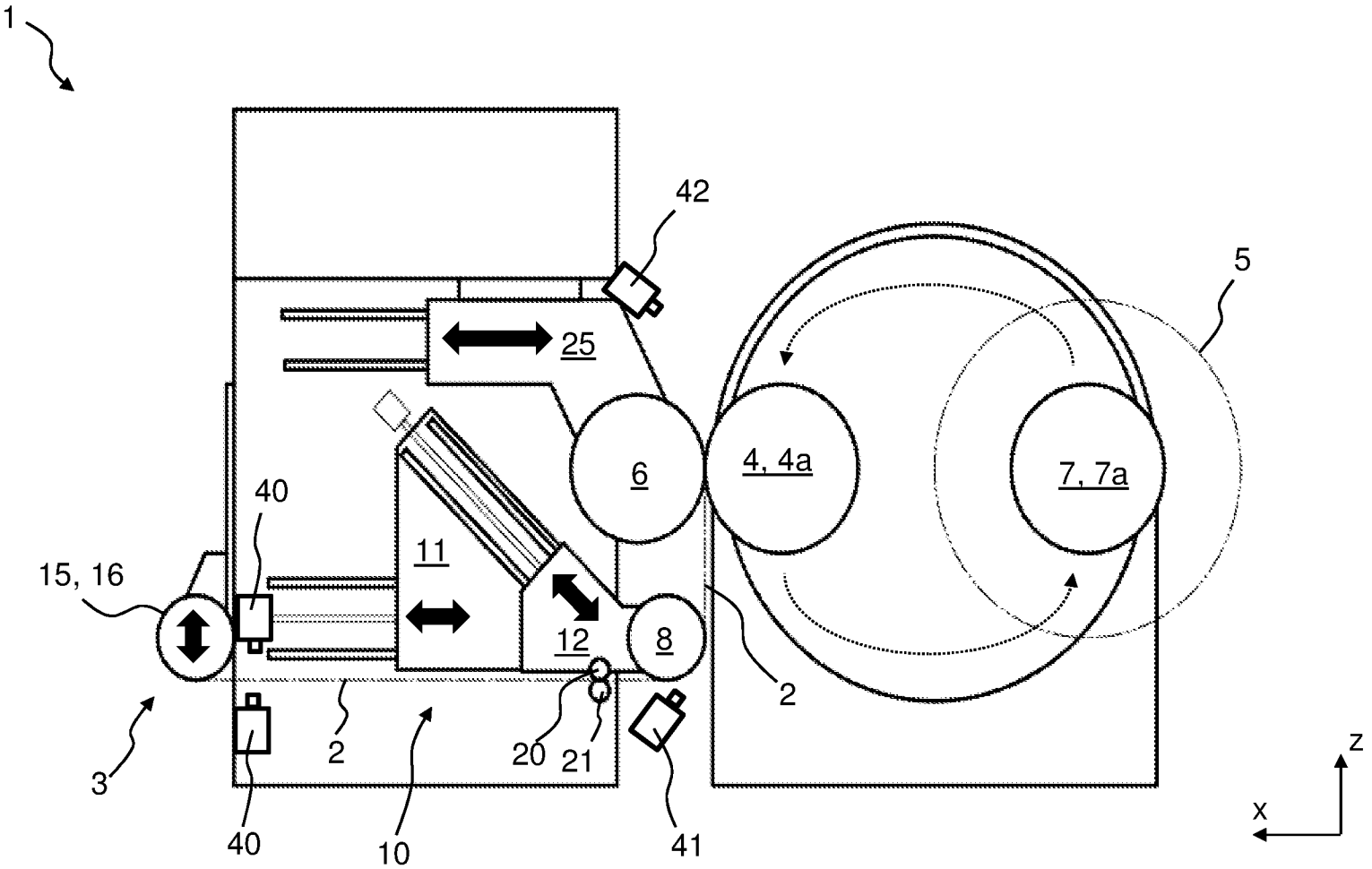

Various embodiments of the invention are described below by way of example with reference to the drawings. The same subject-matters have the same reference signs. The corresponding figures of the drawings show in detail:

FIG. 1: an assembly of a film winding system and a film stretching unit;

FIGS. 2A, 2B:

various embodiments depicting a 0° and 90° degree of wrapping on a contact roller of FIGS. 3A to 3E:

various embodiments describing that the degree of wrapping on a contact roller of a film winding system can be changed very easily; and FIG. 4: an embodiment describing a discharge device in a film winding system.

FIG. 1 shows an assembly 100 comprising a film winding system 1 according to the invention and a film stretching unit 110. The film stretching unit 110 can be configured as a longitudinal stretching stage or as a transverse stretching stage or as a sequential stretching unit with a longitudinal stretching stage and a transverse stretching stage or as a simultaneous stretching unit. The film stretching unit 110 is used to produce a plastic film web 2, which is also referred to below as film web 2. For this purpose, the film stretching unit 110 is divided into various zones 110*a*, 110*b*, 110*c*, 110*d* and 110*e*. Of course, not all of these zones 110*a*, 110*b*, 110*c*, 110*d* and 110*e* need actually to be present. In the various zones 110*a* to 110*e*, the film web 2 is exposed to different temperatures in order to generate or adjust certain film properties. The first zone 110*a* is also referred to as the preheating zone. The second zone 110*b* is referred to as the stretching zone, whereas the third zone 110*c* is referred to as the further heating zone. The fourth zone 110*d* is also referred to as the neutral zone and the fifth zone 110*e* as the cooling zone. In principle, there may be fewer or more neutral zones between the individual zones 110*a* to 110*e* to ensure separation of the zones 110*a* to 110*e* so that the individual zones 110*a* to 110*e* have less influence on each other (the air flows from one zone 110*a* to 110*e* to the other). The film stretching unit 110 makes it possible to produce film webs having a width larger than 2 m, 3 m, 4 m, 5 m, 6 m, 7 m, 8 m, 9 m, 10 m, 11 m, 12 m, 13 m, or larger than 15 m, but which is preferably smaller than 17 m, 16 m, 15 m, 14 m, 13 m, 12 m, 11 m, 10 m, 9 m, 8 m, 7 m, 6 m, 5 m, 4 m, or smaller than 3 m.

The film stretching unit 110 comprises an entry area 111, wherein a film to be stretched can be fed to the film stretching unit 110 at its entry area 111. At the end of the film stretching unit 110, i.e. at its exit area 112, the stretched film web 2 exits. The exit area 112 of the film stretching unit 110 is connected to a film entry area 3 of the film winding system 1 according to the invention.

In the following FIGS. 2A, 2B, 3A to 3E and 4, the structure of the film winding system 1 according to the invention is described in more detail.

As explained before, different types of film should be wound up differently, because only then can it be ensured that winding is carried out without folds and that sufficient air is introduced between the individual layers so that the film web 2 can be unwound without difficulty in subsequent process steps. The method of winding according to the invention also ensures that the film web 2 does not tear.

Figure 2A:
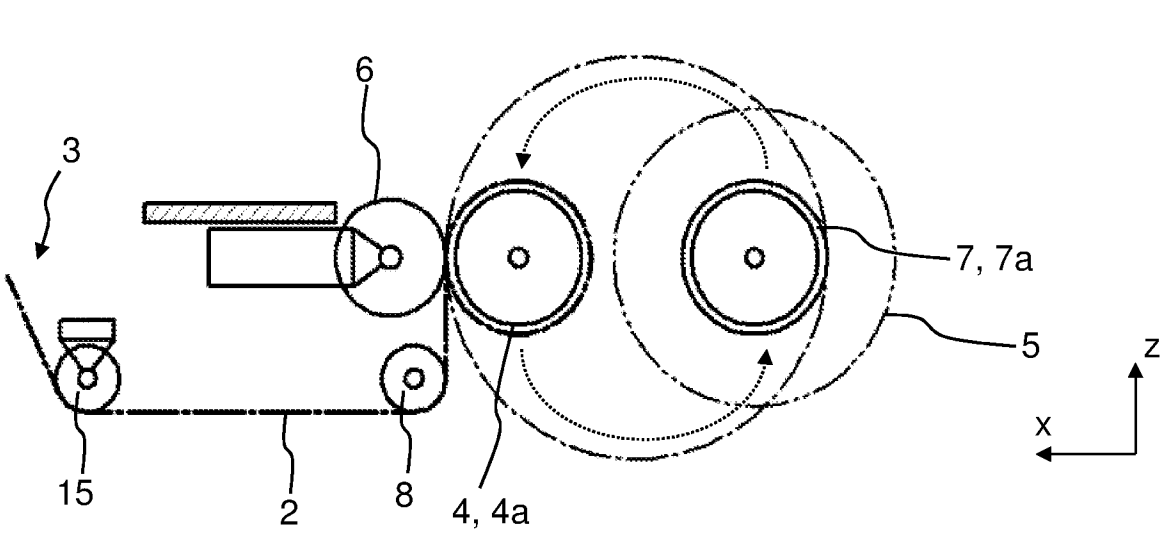
Figure 2B:
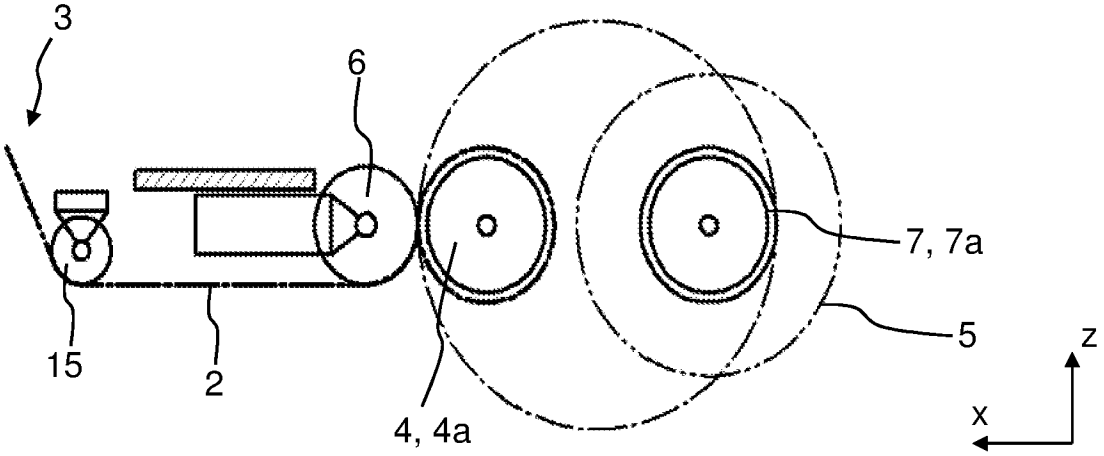

FIGS. 2A and 2B show an embodiment describing a film winding system 1 in very general terms. The film web 2 is fed from the film stretching unit to the film winding system 1. This is done via the film entry area 3. The film web 2 then runs towards a first winding station 4, which is in a winding position in FIGS. 2A and 2B. The first winding station 4 is configured to wind the film web 2 into a film bale 5.

In FIG. 2A, the film web 2 is fed to the first winding station 4 via a 0° wrapping (degree of wrapping). In FIG. 2B, the film web 2 is fed to the first winding station 4 via a 90° wrapping (degree of wrapping). A contact roller 6 is provided for this purpose. In FIG. 2A, the film web 2 is fed vertically to the contact roller 6 and the film web 2 lies in the free space between the contact roller 6 and the first winding station 4 and is immediately wound up into the film bale 5. A possible bending of the contact roller 6 has less influence on the film web 2 with a degree of wrapping of 0° compared to a degree of wrapping of 90°. Smaller degrees of wrapping allow the air entrapment to be kept constant or uniform conditions to be created on the film bale 5 despite the slightly unsteady running of the film web 2, because the film web 2 first runs onto the contact roller 6.

In FIG. 2B, however, the film web is fed horizontally to the contact roller 6. The film web 2 is in contact with the contact roller 6 over approximately one quarter of its circumferential surface. This means that the film web is deflected by 90°. At a degree of wrap of 90°, possible bending of the contact roller 6 due to its own weight has a stronger negative influence than at 0°. The bending ensures that the film web 2 hits the contact roller 6 flat on the underside. Because of the bending, the wrapping is somewhat larger at the edges of the film web 2 and in the middle of the film web 2, which can lead to folding. Thinner film webs 2 are more affected by fluttering, which is why the degree of wrapping should be selected to be larger in order to calm the film web 2. On the other hand, thicker film webs 2 should be guided over the contact roller 6 with a smaller degree of wrapping in order to avoid the formation of folds. The following figures describe a corresponding dynamic adjustment of the degree of wrapping.

With regard to FIGS. 2A and 2B, it is further shown that the first winding station 4 comprises a base body 4*a*. The base body 4*a* of the first winding station 4 can be set into a rotational movement. This can be done, for example, by means of an (electric) motor. In the simplest case, the base body 4*a* can be a (hollow) cylindrical piece of cardboard. However, the base body 4*a* can also be made of metal. A second winding station 7 is also shown. The second winding station 7 also comprises a base body 7*a*. This base body 7*a* can also be set in a rotational movement. In this way, the film web 2 can also be wound around the base body 7*a* of the second winding station 7. In the figures shown, the first winding station 4 is moved to the winding position. In the winding position, the first winding station 4 is arranged adjacent to the contact roller 6. In contrast, the second winding station 7 is moved or pivoted into an unloading position. In the unloading position, the film bale 5 can be removed from the respective, in this case second, winding station 7. In FIG. 2A, arrows indicate that the first winding station 4 can be moved or pivoted from the winding position to the unloading position. Similarly, in this case, the second winding station 7 can be moved or pivoted from the unloading position (after the film bale 5 has been removed) to the winding position. The movement from the winding position to the unloading position and back to the winding position is preferably circular or approximates a circular movement. The movement could also comprise different, preferably arcuate, segments that adjoin each other or are connected to each other by straight sections. Furthermore, a cutting device (not shown) is provided. The cutting device is configured to cut through the film web 2 along its entire width when the first or second winding station 4, 7 is pivoted in the direction of the unloading position, wherein the other winding station 7, 4 is then configured to be pivoted into the winding position to such an extent that the respective base body 4*a*, 7*a* immediately comes into contact with the now cut-off new beginning of the film web 2 and winds this new beginning onto the base body 4*a*, 7*a* which has already been set in rotation. The cutting device preferably moves at an angle (in the X-direction and Y-direction) in order to make a straight cut in the film web 2 due to the speed of movement of the film web 2. However, the cutting device could also move straight (in the Y-direction only), in which case the film web 2 would be cut at an angle.

With regard to FIGS. 3A, 3B, 3C, 3D and 3E, it is described in detail how the degree of wrapping of the film web 2 at the contact roller 6 can be adjusted as desired.

Figure 3A:
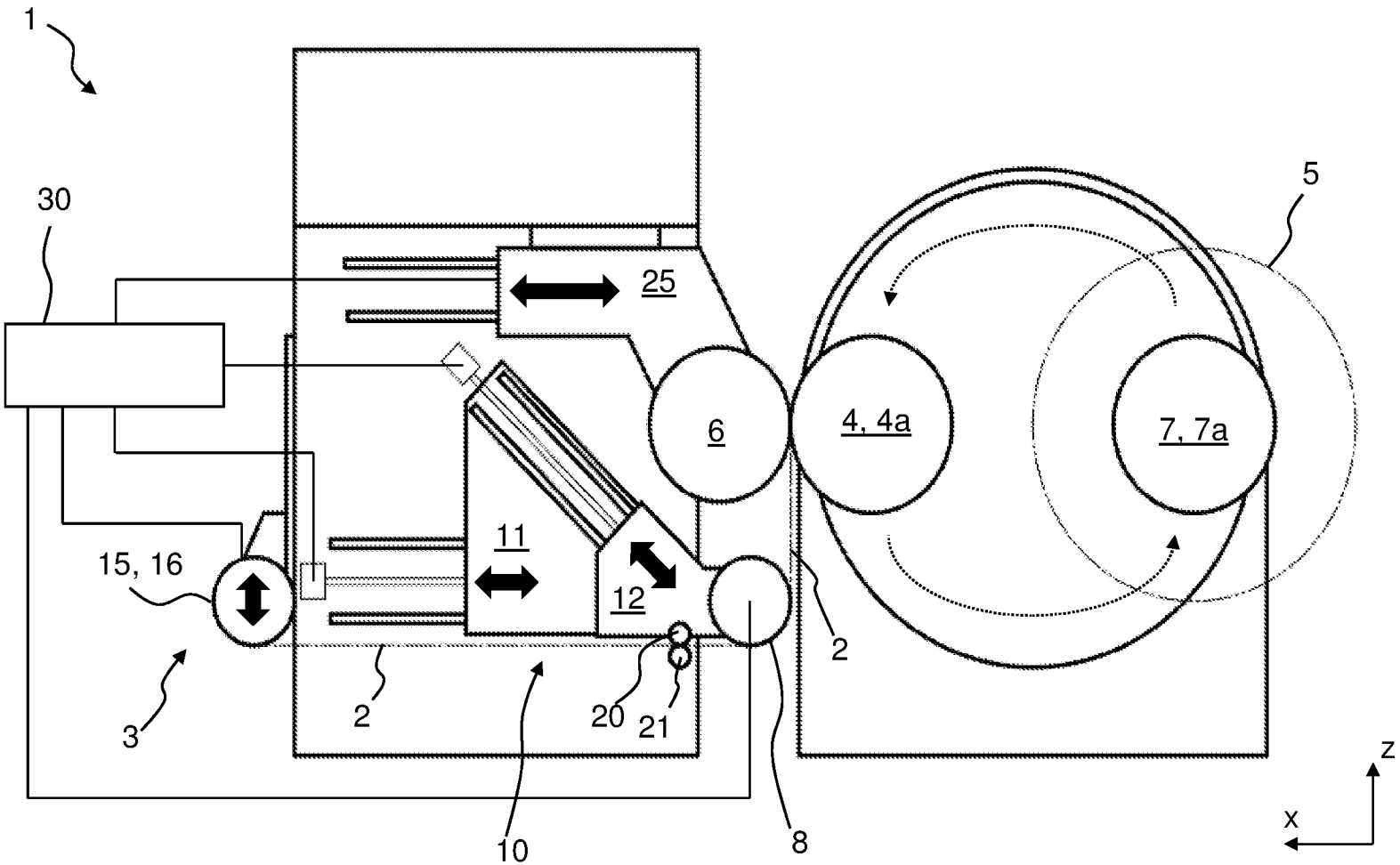

FIG. 3A shows how a degree of wrapping of 0° is achieved. Basically, a contact roller 6 and a measuring roller 8 are provided. The contact roller 6 is arranged in particular directly (less than 10 cm, 8 cm, 6 cm, 4 cm, 2 cm, 1 cm) adjacent to the first winding station 4, which in this case is in the winding position. Preferably, the contact roller 6 contacts the first winding station 4. When several winding stations 4, 7 are used, this obviously applies with regard to that winding station 4, 7 which is in the winding position. The contact roller 6 is configured to guide the film web 2 to the respective, in this case to the first winding station 4. The measuring roller 8 is arranged before (in front of) the contact roller 6 in the movement direction of the film web 2 and is used to guide the film web 2 to the contact roller 6. Furthermore, a first adjustment device 10 is provided and configured to move the measuring roller 8 along a travel path relative to the contact roller 6 in such a way that a desired degree of wrapping over which the film web 2 covers the contact roller 6 can be adjusted or changed.

The diameters of the contact roller 6 and the measuring roller 8 are different. They could also be the same. In order to achieve a degree of wrapping of 0°, the film web 2 between the measuring roller 8 and the contact roller 6 preferably runs exclusively with a component in the vertical direction (perpendicular to the ground). The measuring roller 8 is in a first position in FIG. 3A. To set a degree of wrapping of 0°, the measuring roller 8 only has to be arranged at a distance from the contact roller 6 in the vertical direction (Z-direction). If the contact roller 6 and the measuring roller 8 have different diameters, the measuring roller 8 must be arranged offset from the contact roller 6 in such a way that both the contact roller 6 and the measuring roller 8 merely touch the (same) plane (YZ plane), this plane being perpendicular to the ground. The film web 2 runs through this plane accordingly. In this case, the longitudinal axes (=axes of rotation) of the rollers 6, 8 of different sizes would be offset from one another in the X direction. A distance between the measuring roller 8 and the contact roller 6 is smaller than 3 m, 2.5 m, 2 m, 1.5 m or smaller than 1 m, in particular for a degree of wrapping of 0°.

The contact roller 6 and the measuring roller 8 rotate in the same direction. The contact roller 6 and the base body 4*a*, 7*a* of the respective winding station 4, 7 in the winding position rotate in different directions.

In principle, both the contact roller 6 and the measuring roller 8 could be tempered. Such a temperature control (cooling or heating) could be achieved by an appropriate fluid (air, liquid).

The distance between the measuring roller 8 and the contact roller 6 can be constant over the entire travel path of the measuring roller 8. Preferably, however, the distance changes. The distance can become smaller or larger over the entire travel path.

The first adjustment device 10 is configured to move the measuring roller 8 relative to the contact roller 6 even during winding of the film web 2. This allows the degree of wrapping to be changed during operation. The moving of the measuring roller 8 relative to the contact roller 6 is in particular stepless. It could also take place in discrete steps. The moving is carried out pneumatically, electrically, hydraulically and/or mechanically, for example.

The first adjustment device 10 is further configured to move the measuring roller 8 along the entire travel path or along the predominant part of the travel path with a first movement vector and/or with a second movement vector. FIG. 3A shows that the first adjustment device 10 comprises a first guide system 11 for this purpose, wherein the first guide system 11 is movable with the first movement vector. Furthermore, a second guide system 12 is shown, wherein the second guide system 12 is movable with the second movement vector.

The first and/or second guide system 11, 12 can, for example, be a sled, rail and/or chain system. In FIG. 3A, the measuring roller 8 is attached to the second guide system 12, whereas the second guide system 12 is attached to the first guide system 11. Both guide systems 11, 12 can preferably be controlled independently of each other. It would also be possible for the measuring roller 8 to be attached to the first guide system 11, whereby the first guide system 11 could in turn be attached to the second guide system 12. If the first guide system 11 is attached to the second guide system 12, then a movement of the second guide system 12 will always also result in a movement of the first guide system 11, whereas a movement of the first guide system 11 will not result in a movement of the second guide system 12. The opposite is true if the second guide system 12 is mounted on the first guide system 11.

The first movement vector comprises only one component in the X-direction, wherein the X-direction is parallel to the ground in the direction of the film entry area 3. The component in the X-direction is larger than zero, whereas all other components are zero. The second movement vector comprises a component in the X-direction and a component in the Z-direction. The component in the Z-direction extends perpendicular away from the ground (upward) and is perpendicular to the component in the X-direction. A component in the Y-direction is zero. The component in the Y-direction would otherwise run parallel to the axis of rotation or longitudinal axis of the contact roller 6 or the measuring roller 8.

This makes it possible for the measuring roller 8 to be moved only horizontally in the X-direction (i.e. away from the first or second winding station 4, 7) via the first guide system 11. Via the second guide system 12, the measuring roller 8 can be moved slanted. The second movement vector preferably forms an angle of 45° with an XY-plane. In particular, however, the angle could also be larger than 10°, 20°, 30°, 40°, 50°, 60° or greater than 70°. Preferably, however, the angle is smaller than 80°, 75°, 65°, 55°, 45°, 35°, 25° or smaller than 15°.

In principle, the travel path of the measuring roller 8 could also be arc-shaped. This would apply in particular to the second guide system 12. In this context, the travel path of the measuring roller 8 could also comprise several arc-shaped segments that are connected directly to each other or by linear sections.

FIG. 3A shows that the measuring roller 8 is moved to the first position in order to set a degree of wrapping of 0°. In this position, the measuring roller 8 is only vertically spaced apart from the contact roller 6. In this embodiment, the measuring roller 8 is arranged below the contact roller 6. However, it could also be arranged above the contact roller 6. This ensures that the film web 2 is moved between the measuring roller 8 and the contact roller 6 almost exclusively with a vertical component.

Optionally, a deflection roller 15 and a second adjustment device 16 are also provided. The second adjustment device 16 is preferably a sled, rail and/or chain system. The drive is again preferably pneumatic, electric, hydraulic and/or mechanical. The deflection roller 15 is arranged between the film entry area 3 and the measuring roller 8. The second adjustment device 16 is configured to move the deflection roller 15 in the vertical direction (Z-direction) in such a way that the film web 2 is aligned approximately horizontally (less than 5° deviation) between the deflection roller 15 and the measuring roller 8 or between the deflection roller 15 and the contact roller 6. The deflection roller 15 could also be temperature controlled (heated and/or cooled). If the measuring roller 8 is therefore moved at an angle via the second guide system 12, i.e. also with a component in the Z-direction (in the vertical direction), then the deflection roller 15 is also moved with a component in the Z-direction. The diameter of the deflection roller 15 can correspond to the diameter of the contact roller 6 or the diameter of the measuring roller 8 or deviate from these diameters.

In addition to adjusting the deflection roller 15 in the vertical direction, the deflection roller 15 could also be adjusted in the horizontal direction (X-direction). The deflection roller 15 could therefore be moved with a movement vector that comprises both a component in the X-direction and a component in the Y-direction. In the simplest case, the deflection roller 15 would be moved along a straight line, i.e. at an angle. However, it would also be possible for the travel path of the deflection roller 15 to be arc-shaped. In principle, the travel path of the deflection roller 15 could also comprise several arcuate segments that are connected directly to each other or by at least one linear section.

In principle, it would also be possible for the travel path of the deflection roller 15 to correspond to the travel path of the measuring roller 8. Preferably, both the deflection roller 15 and the measuring roller 8 would complete the same movement sequence at the same time.

Optionally, first and second stabilizing rollers 20, 21 are also provided and arranged at a first edge region of the film web. The first stabilizing roller 20 can be brought into contact with an upper side of the film web 2. The second stabilizing roller 21, on the other hand, can be brought into contact with an underside of the film web 2. The first and second stabilizing rollers 20, 21 are spaced apart from one another only in the vertical direction and are arranged directly above one another. For the second edge region of the film web, which is opposite the first edge region, there are preferably also a third and a fourth stabilizing roller (not shown). The third and fourth stabilizing rollers are preferably only offset in the Y-direction from the first and second stabilizing rollers 20, 21, respectively. The stabilizing rollers 20, 21 are preferably arranged between the deflection roller 15 and the measuring roller 8. The stabilizing rollers 20, 21 are preferably arranged closer to the measuring roller 8 or to the contact roller 6 than to the deflection roller 15.

Preferably, a third adjustment device 25 is also provided. The third adjustment device 25 is preferably again a sled, rail and/or chain system. The drive of the third adjustment device 25 can also again be pneumatic, electric, hydraulic and/or mechanical. The contact roller 6 is attached to the third adjustment device 25. The third adjustment device 25 is configured to move the contact roller 6 in the X-direction. This ensures that the distance between the contact roller 6 and the increasingly thick film bale 5 remains constant. Alternatively, the respective first or second winding station 4, 5, which is currently in the winding position, could also be moved in the X-direction via an adjustment device so that the distance from the outermost position of the film bale 5 towards the contact roller 6 remains constant.

Furthermore, a control device 30 is provided. For reasons of clarity, the control device 30 is only shown in FIG. 3A. It can of course also be provided in all other figures. The control device 30 is configured to control the first adjustment device 10 in such a way that it moves the measuring roller 8 in such a way that a predetermined setpoint for the degree of wrapping is achieved. It is obvious that the second and/or the third adjustment device 16, 25 could also be controlled by the control device 30. Based on the setpoint to be set, the control device 30 can select a specific position for the measuring roller 8 in order to subsequently move the measuring roller 8 to this position. The relationships between the setpoint and the position of the measuring roller 8 can be stored in a look-up table for example. The position to be set for the measuring roller 8 can also still be corrected by the current position of the contact roller 6 (which can be moved along the X direction depending on the thickness of the film bale 5). Instead of a look-up table, the position of the measuring roller 8 to be set can also be calculated by means of a system of equations. Parameters of this system of equations are at least the setpoint for the degree of wrapping and optionally also the position of the contact roller 6. The control device 30 then adjusts the position of the measuring roller 8 by controlling the first and/or second guide system 11, 12.

The setpoint can be loaded from a data memory (not shown) or received in writing or from an input unit (e.g., computer, tablet computer, external control unit, and/or mobile device). In principle, the control device 30 would also be able to determine the setpoint based on at least one material property of the film web. These material properties include, for example, film type, material thickness, material strength, material elongation, shrinkage, and/or film temperature. It would also be possible for the control device 30 to determine the setpoint from a line parameter of the film stretching unit 110. These line parameters include, for example, the line speed and the film tension. In order to be able to determine the film tension, a force measuring device (not shown) is preferably also provided, which is arranged on the measuring roller 8. The force measuring device 8 is configured to measure a current value (actual value) for the film tension and transmit it to the control device 30. Based on this actual value, the control device 30 can control the first adjustment device 10 in such a way that the degree of wrapping is increased, reduced or maintained. This prevents the film web 2 from tearing.

Figure 3B:
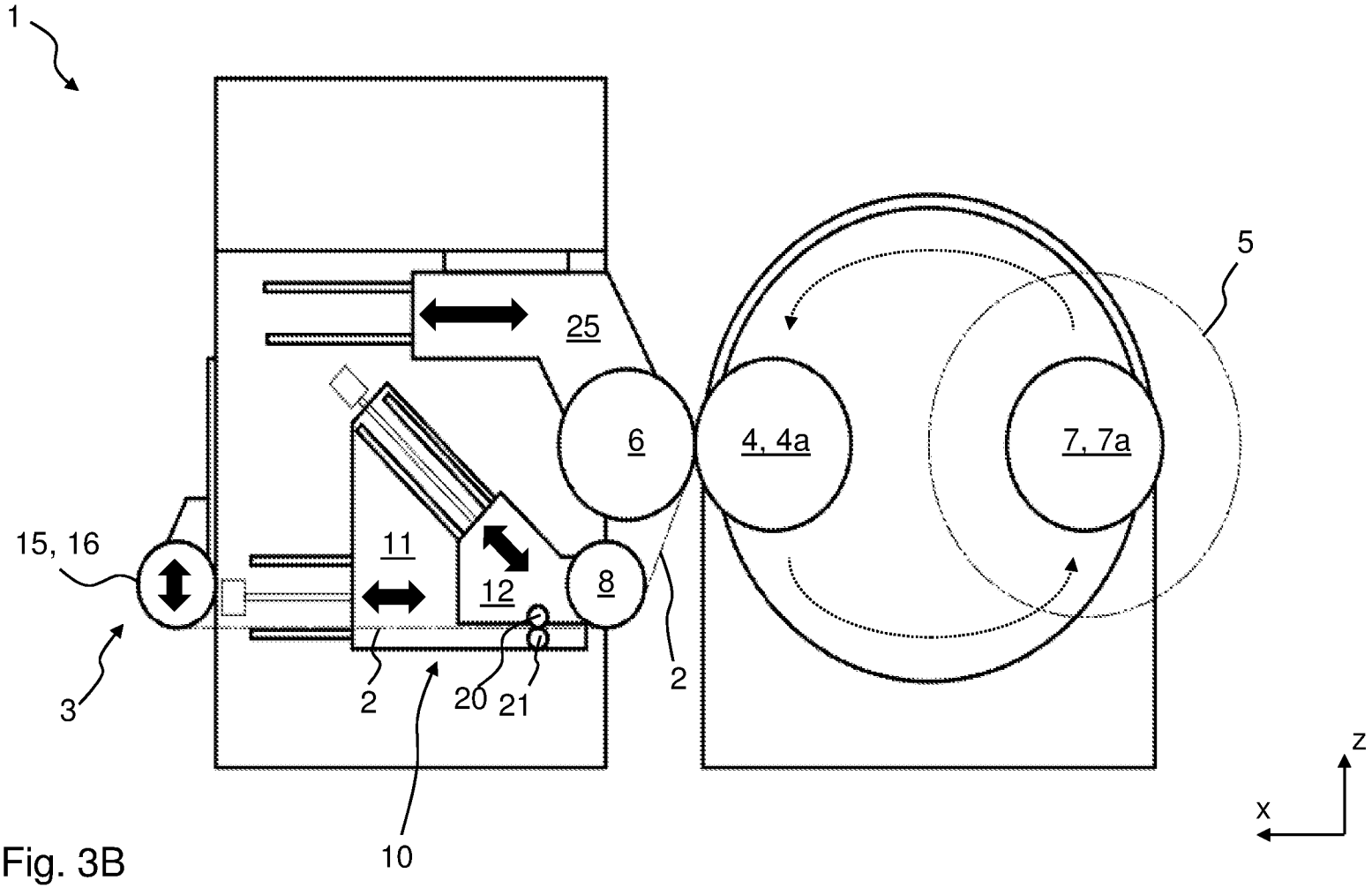

With reference to FIG. 3B, a degree of wrapping of 22.5° is now shown. This degree of wrapping was achieved by moving the measuring roller 8 with a first movement vector (e.g. exclusively) along the X-direction. The measuring roller 8 was moved closer to the direction of the film entry area 3. However, it would also be possible for the measuring roller 8 to be moved with a second movement vector comprising both a component in the X-direction and a component in the Z-direction.

Figure 3C:
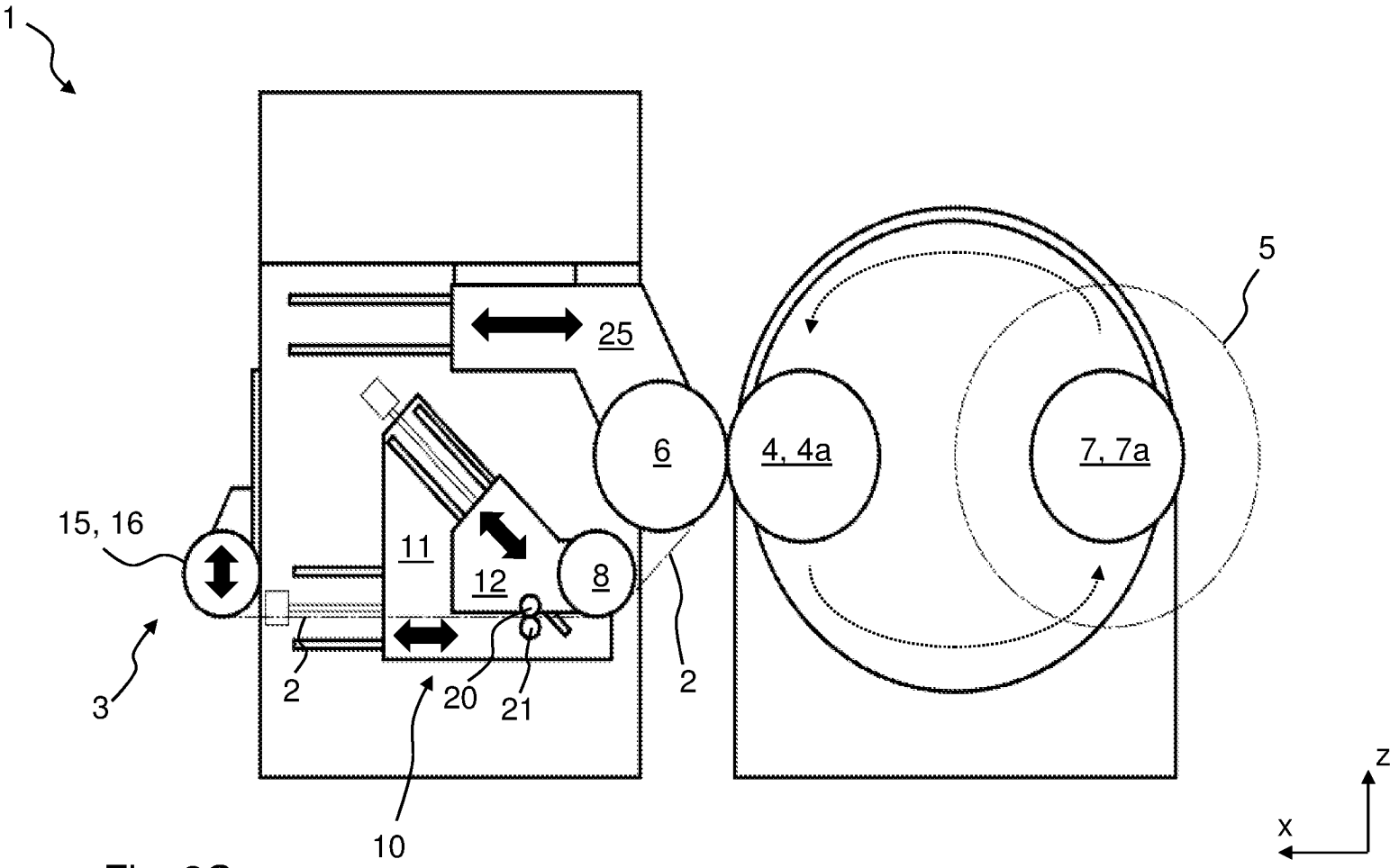

FIG. 3C shows a degree of wrapping of 45°. This is achieved by moving the measuring roller 8 with a second movement vector along the X-direction and along the Z-direction. In this context, the deflection roller 15 was also moved in its vertical position by the second adjustment device 16. As a result, the film web 2 is still aligned horizontally between the deflection roller 15 and the measuring roller 8. In principle, the measuring roller 8 could additionally or alternatively also be moved with the first movement vector or exclusively with the first movement vector (in the X direction) in order to be able to set the degree of wrap of 45°.

Figure 3D:
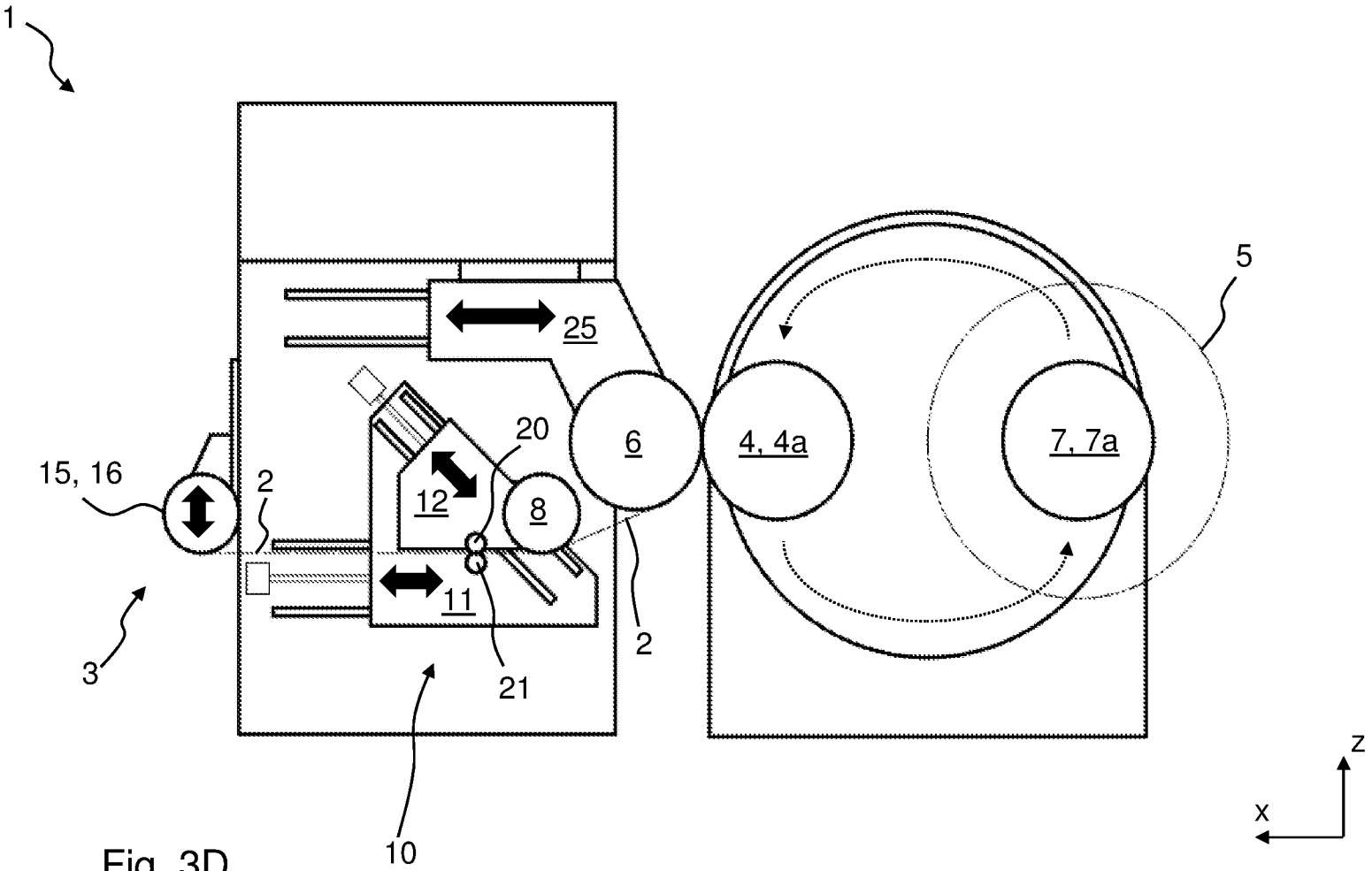

FIG. 3D shows a degree of wrapping of 67.5°. This is achieved by further moving the measuring roller 8 with a second movement vector along the X-direction and along the Z-direction. In this context, the deflection roller 15 was also moved in its vertical position by the second adjustment device 16. As a result, the film web 2 is still aligned horizontally between the deflection roller 15 and the measuring roller 8. In principle, the measuring roller 8 could also be moved with the first movement vector or exclusively with the first movement vector (in the X direction).

The first and second stabilizing rollers 20, 21 are preferably adjustable in their position (in particular vertically) via the first adjustment device 10, as are the third and fourth stabilizing rollers. The stabilizing rollers 20, 21 are preferably coupled to the second guide system 12. If the measuring roller 8 is adjusted (moved) with the second movement vector (X-direction and Z-direction), then preferably the stabilizing rollers 20, 21 are also changed (moved) at least in their vertical position.

Figure 3E:
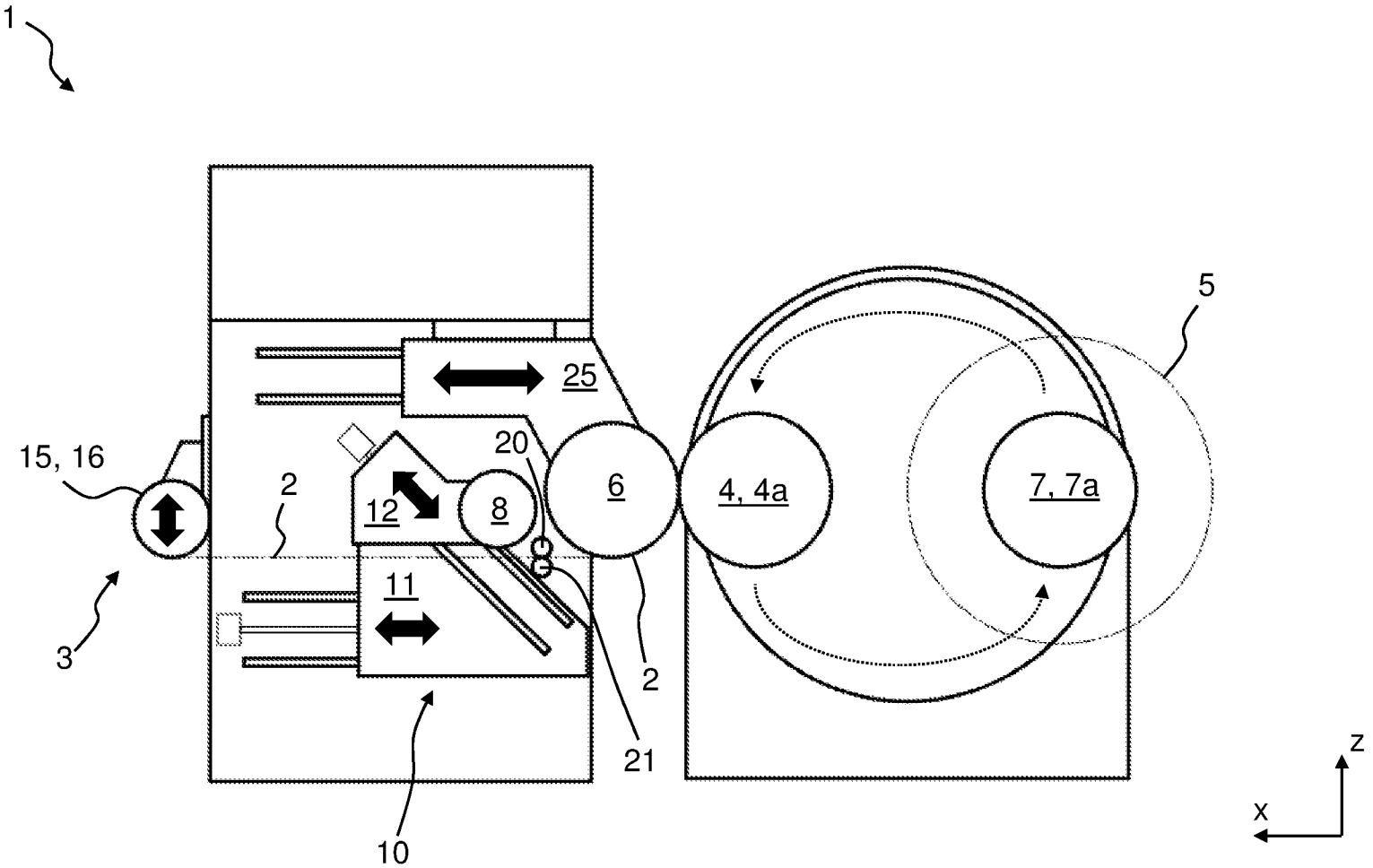

FIG. 3E shows a degree of wrap of 90°. This is achieved by further moving the measuring roller 8 with a second movement vector along the X-direction and along the Z-direction. In this context, the deflection roller 15 was also moved in its vertical position by the second adjustment device 16. As a result, the film web 2 is still aligned horizontally between the deflection roller 15 and the contact roller 6. In principle, the measuring roller 8 could also be moved with the first movement vector or exclusively with the first movement vector (in the X direction). In this embodiment, the measuring roller 8 is no longer in contact with the film web 2. However, this would not have to be the case.

This is the second position of the measuring roller 8. In this case, the measuring roller 8 is only spaced apart from the contact roller 6 in the horizontal direction. By using the control device 30, the measuring roller 8 can preferably be moved as desired between the first position (FIG. 3A) and the second position (FIG. 3E). The stabilizing rollers 20, 21 are preferably arranged closer to the contact roller 6 at a higher degree of wrapping than at a lower degree of wrapping.

Comparing FIGS. 3A (degree of wrapping 0°) and FIG. 3E (degree of wrapping 90°), it can be seen that the second guide system 12 is clearly displaced relative to the first guide system 11.

The first, second and/or third adjustment device 10, 16, 25 preferably also comprise a braking and/or locking device which ensures that the respective adjustment device 10, 16, 25 remains permanently in position (even in the event of a power failure of the respective adjustment device 10, 16, 25) until the braking and/or locking device is released again.

In principle, it would also be possible for the film web 2 to run completely above the contact roller 6. In this case, the measuring roller 8 and the deflection roller 15 would be arranged in mirror image.

FIG. 4 shows another embodiment of the film winding system 1. At least one discharge device 40, 41, 42 is also shown here. This discharge device 40, 41, 42 is arranged in the area of the film web 2 and is configured to discharge an electrical charge on the film web 2 or on the film bale 5. A discharge device 40 can, for example, be arranged between the deflection roller 15 and the measuring roller 8. This discharge device 40 can be arranged above and/or below the film web 2. In addition or alternatively, a discharge device 41 can also be arranged in the area of the measuring roller 8 or between the measuring roller 8 and the contact roller 6. In addition or alternatively, a discharge device 42 can also be arranged directly on the film bale 5 after the contact roller 6. The discharge device 40, 41, 42 can be a plurality of flexible electrically conductive metal strips (for example a type of tinsel strip) which can be brought into contact with the film web 2. These metal strips preferably extend over the entire width of the film web 2 (in the Y direction). In addition or alternatively, the at least one discharge device 40, 41, 42 may be a discharge conductor which is arranged at a distance from the film web 2 (the at least one discharge conductor is arranged without contact with the film web 2) and is energized via an alternating electric field (high voltage: more than 500 V, 1000 V, 2000 V, 3000 V, 4000 V, 5000 V, 6000 V, 7000 V, 8000 V, 9000 V or more than 10000 V). The distance between the at least one discharge conductor and the film web is adjustable and, in particular, can be varied continuously or in discrete steps (e.g. automatically) during operation. The distance can be set, for example, as a function of film type and/or voltage.

In principle, it is also possible for the diameter of the contact roller 6 to be variable. This means that a bend-adjustable contact roller can be used. Instead of a bend-adjustable contact roller 6, a crowned contact roller 6 can also be used. Such a crowned contact roller 6 is known, for example, from DE 10 2009 048 074 A1, wherein the content regarding the crowned contact roller 6 is hereby incorporated by reference. This results in a more uniform film bale 5, even if the thickness distribution of the film web 2 is different or if very smooth surfaces are produced (for example with optical films), which tend to telescope.

The contact roller 6, the measuring roller 8 and the deflection roller 15 preferably extend over the entire width of the film web 2 (and possibly beyond). The stabilizing rollers 20, 21 extend only over (a part of) the respective edge region of the film web 2.

Furthermore, there may be additional control units which are arranged between the deflection roller 15 and the measuring roller 8 and/or between the measuring roller 8 and the contact roller 6 and/or between the contact roller 6 and the corresponding winding station 4, 7 in the winding position and detect further film properties (for example film thickness, film temperature, crack formation) and transmit these film properties to the control device 30 so that the control device 30 adjusts the degree of wrapping on the basis of the further film properties. These additional control units may be, for example, optical cameras and/or IR sensors.

In principle, it would also be possible for the measuring roller 8 and/or the deflection roller 15 and/or the contact roller 6 to be driven by a common drive device. Synchronization could, for example, take place via corresponding gear wheels and/or chains and/or belts. However, it is also possible that the measuring roller 8 and/or the deflection roller 15 and/or the contact roller 6 are each driven via their own drive device.

In the following, some features are emphasized separately.

It is very beneficial if the first adjustment device 10 is configured to move the measuring roller 8 relative to the contact roller 6 continuously or in discrete steps.

It is also very beneficial if the ratio between the component in the X-direction and the component in the Z-direction of the second movement vector is constant over most of the travel path or over the entire travel path.

It is also very beneficial if the at least one discharge device 40, 41, 42 comprises:

a) a plurality of flexible electrically conductive metal strips which can be brought into contact with the film web 2; and/or b) a discharge conductor which can be arranged at a distance from the film web 2, wherein an alternating electric field can be applied to the discharge conductor.

The invention is not limited to the embodiments described. Within the scope of the invention, all described and/or drawn features can be combined with each other as desired.

The invention claimed is:

1. A film winding system for a film stretching unit with the following features:

a film entry area is provided, via which a film web to be wound up can be fed to the film winding system;

a first winding station is provided, wherein the first winding station is configured in a winding position to wind the film web into a film bale;

a contact roller and a measuring roller are provided, wherein the contact roller is arranged adjacent to the first winding station in the winding position and is configured to guide the film web to the first winding station;

the measuring roller is arranged in front of the contact roller in the movement direction of the film web and is configured to guide the film web towards the contact roller;

a first adjustment device is provided and configured to move the measuring roller relative to the contact roller along a travel path in such a way that a degree of wrapping over which the film web covers the contact roller can be varied; and, a control device configured to control the first adjustment device in such a way that it moves the measuring roller in such a way that a predetermined setpoint value for the degree of wrapping is achieved.

2. The film winding system according to claim 1, wherein the following feature:

the first adjustment device is configured to move the measuring roller relative to the contact roller along the travel path during winding of the film web in order to change the degree of wrapping during operation.

3. The film winding system according to claim 1, wherein the following features:

the first adjustment device is configured to move the measuring roller along the entire travel path or along the predominant part of the travel path:

a) with a first movement vector; and/or b) with a second movement vector;

the first adjustment device comprises:

a) a first guide system, wherein the first guide system is movable with the first movement vector; and/or b) a second guide system, wherein the second guide system is movable with the second movement vector.

4. The film winding system according to claim 3, wherein the following feature:

the measuring roller is:

a) attached to the first guide system; or b) attached to the second guide system;

the first guide system is mounted on the second guide system; or the second guide system is mounted on the first guide system.

5. The film winding system according to claim 1, wherein the following features:

the first adjustment device is configured to move the measuring roller along the entire travel path or along the predominant part of the travel path:

a) with a first movement vector; and/or b) with a second movement vector;

the first movement vector comprises only a component in the X-direction, wherein the X-direction is parallel to the ground in the direction of the film entry area; and/or the second movement vector comprises a component in the X-direction and a component in the Z-direction, wherein the X-direction is parallel to the ground in the direction of the film entry area and wherein the Z-direction extends perpendicularly away from the ground and is perpendicular to the X-direction.

6. The film winding system according to claim 5, wherein the following features:

the measuring roller can be moved further in the Z-direction than in the X-direction-over the entire travel path; or the measuring roller can be moved further in the X-direction than in the Z-direction over the entire travel path; or the measuring roller can be moved the same distance in the Z-direction as in the X-direction over the entire travel path.

7. The film winding system according to claim 5, wherein the following features:

the second movement vector forms with an XY-plane an angle larger than 10° but smaller than 80°.

8. The film winding system according to claim 1, wherein the following feature:

the travel path of the measuring roller is arc-shaped.

9. The film winding system according to claim 8, wherein the following feature:

the travel path of the measuring roller comprises a plurality of arc-shaped segments which are connected directly to one another or by linearly extending sections.

10. The film winding system according to claim 1, wherein the following features:

the first adjustment device is configured to position the measuring roller between a first position and a second position to adjust the degree of wrapping, wherein:

a) the measuring roller in the first position is spaced from the contact roller only in the vertical direction, whereby the film web is movable between the measuring roller and the contact roller almost exclusively with a vertical component, whereby a degree of wrapping of approximately 0° is settable at the contact roller; and/or b) the measuring roller in the second position is spaced from the contact roller only in the horizontal direction, whereby the film web is movable between the measuring roller and the contact roller almost exclusively with a horizontal component, whereby a degree of wrapping of approximately 90° is settable at the contact roller.

11. The film winding system according claim 1, wherein the following features:

the control device is configured to load the setpoint for the degree of wrapping from a data and/or to receive the setpoint from a computer; and/or the control device is configured to load at least one material property of the film web from a data memory and/or to receive at least one material property of the film web from an input unit; and/or the control device is configured to load at least one line parameter of the film stretching unit from a data memory and/or to receive at least one line parameter of the film stretching unit from an input unit, in order to calculate the setpoint for the degree of wrapping from this at least one line parameter.

12. The film winding system according to claim 1, wherein the following features:

the control device is configured to compare the actual value for the film tension with a setpoint for the film tension and to increase, maintain or reduce the setpoint for the degree of wrapping depending on this comparison result.

13. The film winding system according to claim 1, wherein the following features:

a first and a second stabilizing roller are provided and can be arranged on a first edge region of the film web, wherein the first stabilizing roller can be brought into contact with an upper side of the film web and wherein the second stabilizing roller can be brought into contact with an underside of the film web, wherein the first and the second stabilizing rollers are spaced apart from one another only in the vertical direction.

14. The film winding system according to claim 1, wherein the following features:

a third adjustment device is provided;

the contact roller is attached to the third adjustment device;

the third adjustment device is configured to move the contact roller in the direction of the film entry area.

15. The film winding system according to claim 1, wherein the following features:

at least one discharge device is provided;

the discharge device is arranged in the region of the film web and is configured to discharge electrical charge on the film web and/or the film bale.

16. The film winding system according to claim 1, wherein the following features:

the first winding station comprises a base body, wherein the base body of the first winding station can be set into a rotational movement and wherein the film web can be wound around the base body;

a second winding station with a base body is provided, wherein the base body of the second winding station can be set in a rotational movement and wherein the film web can be wound around the base body;

the first winding station is configured to be pivoted from the winding position in which it is located adjacent to the contact roller to an unloading position, wherein the wound film bale is removable from the first winding station in the unloading position, wherein the second winding station is configured to be pivoted from the unloading position to the winding position at the same time;

wherein the second winding station is configured to be pivoted further into the winding position in such a way that the base body of the second winding station immediately comes into contact with the new beginning of the film web now formed.

17. The film winding system according to claim 1, wherein the following features:

the contact roller is:

a) arranged immediately adjacent to the first winding station, wherein the first winding station is in the winding position, wherein the contact roller is in contact with and touches the film bale, or wherein only the film web runs without forming a free space between the contact roller and the film bale; or b) arranged at a distance from the first winding station, the first winding station being in the winding position, wherein the distance is less than 4 cm, 3 cm or less than 1 cm.

18. A film winding system, a film stretching unit with the following features:

a film entry area is provided, via which a film web to be wound up can be fed to the film winding system:

a first winding station is provided, wherein the first winding station is configured in a winding position to wind the film web into a film bale;

a contact roller and a measuring roller are provided, wherein the contact roller is arranged adjacent to the first winding station in the winding position and is configured to guide the film web to the first winding station;

the measuring roller is arranged in front of the contact roller in the movement direction of the film web and is configured to guide the film web towards the contact roller;

a first adjustment device is provided and configured to move the measuring roller relative to the contact roller along a travel path in such a way that a degree of wrapping over which the film web covers the contact roller can be varied, wherein the following features:

a deflection roller and a second adjustment device are provided;

the deflection roller is arranged between the film entry area and the measuring roller;

the second adjustment device is configured to move the deflection roller in the vertical direction in such a way that the film web guided between:

a) the deflection roller and the measuring roller; and/or b) the deflection roller and the contact roller can be aligned approximately horizontally.

19. An assembly of a film stretching unit and the film winding system for a film stretching unit with the following features:

a film entry area is provided, via which a film web to be wound up can be fed to the film winding system;

a first winding station is provided, wherein the first winding station is configured in a winding position to wind the film web into a film bale;

a contact roller and a measuring roller are provided, wherein the contact roller is arranged adjacent to the first winding station in the winding position and is configured to guide the film web to the first winding station;

the measuring roller is arranged in front of the contact roller in the movement direction of the film web and is configured to guide the film web towards the contact roller;

a first adjustment device is provided and configured to move the measuring roller relative to the contact roller along a travel path in such a way that a degree of wrapping over which the film web covers the contact roller can be varied, wherein the assembly further comprises:

a plastic meld is feedable to the film stretching unit at an input area of the film stretching unit;

the film stretching unit comprises various zones in which the plastic melt is heated and/or stretched to form the film web;

an exit area of the film stretching unit is connected to the film entry area of the film winding system.

* * * * *